US012618348B2

(12) United States Patent
Wahlström et al.

(10) Patent No.: US 12,618,348 B2
(45) Date of Patent: May 5, 2026

(54) EXHAUST AFTERTREATMENT UNIT

(71) Applicant: Volvo Truck Corporation, Gothenburg (SE)

(72) Inventors: Gert-Ove Wahlström, Askim (SE); Martin Petersson, Hisings Kärra (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 19/089,884

(22) Filed: Mar. 25, 2025

(65) Prior Publication Data

US 2025/0305433 A1 Oct. 2, 2025

(30) Foreign Application Priority Data

Apr. 2, 2024 (EP) ..... 24168046

(51) Int. Cl.
*F01N 3/20* (2006.01)

(52) U.S. Cl.
CPC ..... *F01N 3/2053* (2013.01); *F01N 3/2066* (2013.01)

(58) Field of Classification Search
CPC .. F01N 3/2053; F01N 3/2066; F01N 2410/00; F01N 3/0878; F01N 2240/20; F01N 3/2892; F01N 13/0093; F01N 13/141; F01N 2560/026; F01N 2610/02; Y02T 10/12; Y02A 50/20
See application file for complete search history.

(56) References Cited

U.S. PATENT DOCUMENTS

| | | | | |
|---|---|---|---|---|
| 4,534,213 | A | 8/1985 | Mirikidani | |
| 6,843,104 | B2 | 1/2005 | Busch | |
| 10,358,961 | B2 * | 7/2019 | Inoue | F01N 3/208 |
| 2015/0122002 | A1 | 5/2015 | Mackaldener | |
| 2016/0333760 | A1 * | 11/2016 | Blomgren | F01N 3/208 |
| 2017/0051654 | A1 * | 2/2017 | Gupta | F01N 13/0093 |

(Continued)

FOREIGN PATENT DOCUMENTS

| | | |
|---|---|---|
| EP | 2836689 B1 | 6/2016 |
| EP | 4112893 A1 | 1/2023 |

(Continued)

OTHER PUBLICATIONS

European Search Report, European Patent Application No. 24168046.1, mailed Sep. 10, 2024, 7 pages.

*Primary Examiner* — Hoang M Nguyen
(74) *Attorney, Agent, or Firm* — Sage Patent Group

(57) ABSTRACT

An exhaust aftertreatment unit for cleaning exhaust gases, the exhaust aftertreatment unit including a fluid channel for providing a fluid pathway for the exhaust gases, the fluid channel having an outer casing; a catalyst casing housing a selective catalyst reduction (SCR) catalyst and an ammonia slip catalyst (ASC) arranged downstream of the SCR catalyst, the catalyst casing being arranged inside the outer casing forming an intermediate space between the inner and outer casings; and a detector configured to measure ammonia and/or NOx in the exhaust gases; wherein the catalyst casing includes one or more perforations upstream of the ASC to enable a by-pass flow of exhaust gases from inside the catalyst casing into the intermediate space, and wherein the detector is arranged in the fluid channel to measure the ammonia and/or NOx in the exhaust gases including the by-pass flow.

20 Claims, 5 Drawing Sheets

(56) References Cited

U.S. PATENT DOCUMENTS

| | | | | |
|---|---|---|---|---|
| 2023/0003153 | A1* | 1/2023 | Wahlström | F01N 3/021 |
| 2023/0105660 | A1* | 4/2023 | Svraka | B01F 23/10<br>60/274 |

FOREIGN PATENT DOCUMENTS

| | | | |
|---|---|---|---|
| EP | 4212708 | A1 | 7/2023 |
| WO | 2012096675 | A1 | 7/2012 |

* cited by examiner

EXHAUST AFTERTREATMENT UNIT

CROSS REFERENCE TO RELATED APPLICATION

This application claims priority to European Patent Application No. 24168046.1, filed on Apr. 2, 2024, the disclosure and content of which is incorporated by reference herein in its entirety.

TECHNICAL FIELD

The disclosure relates generally to aftertreatment systems of a vehicle. In particular aspects, the disclosure relates to an exhaust aftertreatment unit. The disclosure can be applied to heavy-duty vehicles, such as trucks, buses, and construction equipment, among other vehicle types including marine vessels. Although the disclosure may be described with respect to a particular vehicle, the disclosure is not restricted to any particular vehicle.

BACKGROUND

Exhaust gases emitted by internal combustion engines contain various pollutants, including nitrogen oxides (NOx), carbon monoxide (CO), hydrocarbons (HC), and particulate matter (PM). These pollutants have significant environmental impacts, contributing to air pollution, acid rain, and health issues in humans. Consequently, stringent regulations have been implemented worldwide to reduce these emissions, prompting the development of exhaust aftertreatment technologies.

Among these technologies, selective catalyst reduction (SCR) systems have been widely adopted for NOx reduction in e.g., diesel engines. These systems use a reductant, typically urea-based Diesel Exhaust Fluid (DEF) or AdBlue, which is converted into ammonia (NH3) to catalytically reduce NOx into nitrogen (N2) and water (H2O). However, the efficiency of SCR systems depends significantly on the accurate measurement of exhaust gas properties, including NOx and NH3 concentrations, to optimize the injection of the reductant and maximize NOx reduction while minimizing ammonia slip.

Existing exhaust aftertreatment units often face challenges related to the accurate measurement of gas properties, especially under varying engine loads and exhaust flow conditions. These challenges include low pressure differences over sampling channels used to measure gas properties for specific portions of the system, particularly at low engine speeds and loads, resulting in inadequate flow through the sampling channels. This can lead to inaccurate gas property measurements, affecting the ability of the system to make proper responsive actions.

Furthermore, the physical integration of sensors and measurement devices of detectors within the exhaust system poses significant challenges. The limited space between components, such as between different types of catalytic converters, restricts the positioning of the detectors.

Given these challenges, there exists a need for an improved exhaust aftertreatment unit that addresses at least some of the limitations of current systems.

SUMMARY

According to a first aspect of the disclosure, an exhaust aftertreatment unit for cleaning exhaust gases is provided. The exhaust aftertreatment unit comprises: a fluid channel for providing a fluid pathway for the exhaust gases, the fluid channel comprising an outer casing; a catalyst casing housing a selective catalyst reduction, SCR, catalyst and an ammonia slip catalyst, ASC, arranged downstream of the SCR catalyst, the catalyst casing being arranged inside the outer casing forming an intermediate space between the inner and outer casings; and a detector configured to measure ammonia and/or NOx in the exhaust gases, wherein the catalyst casing comprises one or more perforations upstream of the ASC to enable a by-pass flow of exhaust gases from inside the catalyst casing into the intermediate space, and wherein the detector is arranged in the fluid channel to measure the ammonia and/or NOx in the exhaust gases including the by-pass flow. The first aspect of the disclosure may seek to overcome problems with measurement accuracy and/or unwanted emissions and/or exhaust aftertreatment adaptability. For example, owing to the by-pass flow originating from the one or more perforations upstream of the ASC, early detection of potential emission issues can be achieved by measuring ammonia and/or NOx in the by-pass flow (or in the exhaust gas including the by-pass flow). In other words, as the content of the exhaust gases in the by-pass flow is based on conditions upstream of the ASC, the measurement of ammonia and/or NOx by the detector will reflect, at least in part, the conditions upstream of the ASC. For example, an early detection of ammonia, or of an undesirable high amount of ammonia, entering the ASC can be provided by the first aspect. As ammonia may be converted into $N_2O$ in the ASC, and as $N_2O$ is not easily detected downstream of the ASC, this type of emission could otherwise pass unnoticed. $N_2O$ is a stable molecule and a strong greenhouse gas. Moreover, the positioning of the detector may be less fixed, as long as the detector is arranged to measure ammonia and/or NOx in an exhaust stream including the by-pass flow. Hereby, the adaptability of the exhaust aftertreatment unit may be improved, e.g., with regards to space restrictions, as the flexible positioning of the detector may accommodate a compact spacing between catalysts without sacrificing the performance thereof. As compared to prior art solutions using sampling channels for detecting ammonia and/or NOx in the exhaust gases, and in particular for operational conditions in which the flow exhaust gases in the exhaust aftertreatment unit is low (i.e., low flow conditions), e.g., due to low engine loads or low speeds, the measuring accuracy may be poor. By the by-pass flow originating from the one or more perforations upstream of the ASC, and the arrangement of the detector to measure the ammonia and/or NOx in the exhaust gases including the by-pass flow, the measuring accuracy can be improved, in particular under low flow conditions. A technical benefit may include improved measurement accuracy and/or reduced unwanted emissions and/or increased exhaust aftertreatment adaptability.

In some embodiments, the detector is arranged in fluid communication with the intermediate space. A technical benefit may include improved measuring accuracy of ammonia and/or NOx of exhaust gases including the by-pass flow. That is, as the exhaust gases in the intermediate space includes the by-pass flow, the measurement of ammonia and/or NOx by the detector arranged in fluid communication with the intermediate space will reflect, at least in part, the content of the exhaust gases in the by-pass flow. It should be noted that the detector may comprise an ammonia sensor and/or a NOx sensor. In case the detector comprises an ammonia sensor, the ammonia sensor is typically configured to specifically detect ammonia in the exhaust gases. In case the detector comprises a NOx sensor, the NOx sensor is typically configured to specifically detect NOx in the exhaust gases but may additionally (and at least indirectly) be configured to measure the amount of ammonia in the exhaust gases. For example, the detector may be configured to distinguish between NOx and ammonia in the exhaust gases by applying a predefined model that estimates the amount of NOx and/or ammonia in the exhaust gases. Moreover, the NOx-sensor may be cross-sensitive to ammonia, meaning it does not differentiate between NOx and ammonia in the measurement. As NOx-reduction is typically expected to be 100%, or close to 100% downstream of the ASC, a (sudden) indication of NOx by the detector can be assumed to be due to ammonia in the exhaust gases (originating from the by-pass flow).

In some embodiments, the detector is arranged in the fluid channel parallel to, or downstream of, the ASC. A technical benefit may include advantageous positioning of the detector to measure ammonia and/or NOx in an exhaust stream including the by-pass flow. Thus, the positioning of the detector in the fluid channel may be chosen with a high degree of flexibility. By arranging the detector parallel to, or downstream of, the ASC, the by-pass flow will have to pass the detector and ammonia and/or NOx in the by-pass flow may be accurately measured. That is, the detector is arranged in the fluid channel to measure ammonia and/or NOx of the exhaust gases which includes the by-pass flow, or at least a portion of the by-pass flow.

In some embodiments, the fluid channel further comprises an inlet portion for receiving the exhaust gases into the catalyst casing, and an outlet portion for discharging exhaust gases from the catalyst casing and the intermediate space, wherein the detector is arranged in the intermediate space or in the outlet portion. A technical benefit may include advantageous positioning of the detector to measure ammonia and/or NOx in an exhaust stream including the by-pass flow. Thus, the positioning of the detector in the fluid channel may be chosen with a high degree of flexibility. By arranging the detector in the intermediate space or in the outlet portion, the by-pass flow will have to pass the detector and ammonia and/or NOx in the by-pass flow may be accurately measured. In the outlet portion the by-pass flow will typically be mixed, or completely mixed, with the exhaust gases passing through the ASC. Thus, a detector positioned in the outlet portion will be able to detect any ammonia and/or NOx in the exhaust gases including the by-pass flow, or a sudden increase of the same. Positioning of the detector in the outlet portion may be preferred with regards to installation and maintenance of the detector.

In some embodiments, the intermediate space is in direct fluid communication with the outlet portion. A technical benefit may include advantageous positioning of the detector to measure ammonia and/or NOx in an exhaust stream including the by-pass flow. The intermediate space may be described as being upstream and adjacent the outlet portion. As the intermediate space is in direct fluid communication with the outlet portion, e.g., via an orifice or a reduction in diameter of the fluid channel, the by-pass flow will typically be mixed with the exhaust gases passing through the ASC in the outlet portion, or already in the intermediate space upstream of the outlet portion. Thus, a detector positioned in the intermediate space or the outlet portion will be able to detect any ammonia and/or NOx in the exhaust gases including the by-pass flow, or a sudden increase of the same. Direct fluid communication between a first space or portion and a second space or portion may, e.g., be defined as adjacent spaces or portions, or with not emissions reducing components, such as, e.g., catalysts or filters, in between the spaces or portions.

In some embodiments, the exhaust aftertreatment unit further comprises a separation wall arranged in the fluid channel between the outer casing and the catalyst casing, the separation wall being arranged upstream of the one or more perforations for preventing direct fluid communication between the inlet portion and the intermediate space. A technical benefit may include the prevention of mixing with exhaust gases upstream of the catalyst casing. Thus, the by-pass flow is prevented from premature mixing of exhaust gases untreated by the SCR catalyst. Hereby, the measurements of the detector reflect the effectiveness of, or emissions from, the SCR catalyst in a more accurate manner. The separate wall may for example be sealingly connected to an inner wall of the outer casing and an outer wall of the inner casing, such that no exhaust gas is allowed to flow through or by the separation wall. In other words, the separation wall may be arranged such that all of the exhaust gases upstream of the catalyst casing enters the catalyst casing.

In some embodiments, the catalyst casing comprises a catalyst casing inlet and a catalyst casing outlet arranged downstream of the catalyst casing inlet, wherein the SCR catalyst and the ASC are arranged in between the catalyst casing inlet and catalyst casing outlet. A technical benefit may include an organized flow of exhaust gases through the catalyst casing, ensuring that exhaust gases are effectively treated by both the SCR catalyst and ASC in a controlled manner, obviously except for the by-pass flow not being treated by at least the ASC.

In some embodiments, the one or more perforations of the catalyst casing is arranged in between the SCR catalyst and the ASC. A technical benefit may include the precise positioning of the one or more perforations to enable targeted by-pass flow between the SCR catalyst and ASC. Thus, the composition of the by-pass flow reflects that of the exhaust gases being treated by the SCR catalyst but not of the ASC. Hereby, any ammonia (or NOx) which slips out of the SCR catalyst may be detected by the detector.

In some embodiments, the SCR catalyst is physically divided into a SCR upstream part and a SCR downstream part, and wherein the one or more perforations of the catalyst casing is arranged in between the SCR upstream part and the SCR downstream part. A technical benefit may include the precise positioning of the one or more perforations to enable targeted by-pass flow between the SCR upstream part and the SCR downstream part. Thus, the composition of the by-pass flow reflects that of the exhaust gases being treated by the SCR upstream part but not of the SCR downstream part (and hence not the ASC). Hereby, any ammonia (or NOx) which slips out of the SCR upstream part may be detected by the detector.

In some embodiments, the one or more perforations are a plurality of perforations distributed evenly along a circumference of the catalyst casing. A technical benefit may include a uniform by-pass flow out from the catalyst casing. Moreover, by having a plurality of perforations distributed evenly along a circumference of the catalyst casing, the composition of the by-pass flow will better reflect that of the intended position in the catalyst casing. However, it should be mentioned that the one or more perforations alternatively is at least one perforation, such as, e.g., a single perforation. Such at least one perforation may, e.g., be a slit arranged along at least a portion of the circumference of the catalyst casing.

In some embodiments, each one of the one or more perforations is circular, or has a circular cross section. The opening, or diameter, of each one of the one or more perforations may, e.g., be between 1 mm and 25 mm, depending, e.g., on the number of perforations.

In some embodiments, the SCR catalyst and the ASC are comprised in a common catalyst substrate. A technical benefit may include an efficient and/or compact design of the exhaust aftertreatment unit. Thus, the SCR catalyst is formed by an SCR catalyst coating in an upstream portion of the common catalyst substrate, and the ASC is formed by an ASC coating in a downstream portion of the common catalyst substrate. Thus, the one or more perforations is arranged upstream of the ASC coating, and potentially parallel to, or downstream of, the SCR catalyst coating.

In some embodiments, the exhaust aftertreatment unit further comprises a borehole in the SCR catalyst, wherein the one or more perforations are aligned with the borehole. A technical benefit may include targeted by-pass flow to a position within the SCR catalyst. For example, for the embodiment in which the SCR catalyst and the ASC are comprised in a common catalyst substrate, the borehole may be arranged in the common catalyst substrate at the upstream portion comprising the SCR catalyst coating.

In some embodiments, the exhaust aftertreatment unit further comprises an injector configured to inject a reductant upstream of the SCR catalyst. A technical benefit may include improved control over the chemical reactions within the SCR catalyst. Hereby, the NOx reduction can be tailored. The injector is typically arranged just upstream of the SCR catalyst, e.g., just upstream of the catalyst casing. Thus, the injector is arranged such that, in use, the injected reductant follows the exhaust gases into the SCR catalyst.

In some embodiments, the exhaust aftertreatment unit further comprises a control unit configured to adjust the reductant injection rate of the injector in response to the measured ammonia and/or NOx by the detector. A technical benefit may include reduced emissions from the exhaust aftertreatment unit. Thus, a proper response action to an early detection of potential emission issues, based on the measuring of ammonia and/or NOx in the by-pass flow by the detector, can be achieved. For example, an early detection of ammonia, or of an undesirable high amount of ammonia, reaching the ASC with the outcome of an undesirable emission of $N_2O$ out from the exhaust aftertreatment unit, can be used as input to regulate the injection rate of the injector. The typical reductant injected by the injector may, e.g., be an aqueous urea solution, e.g., Diesel Exhaust Fluid (DEF) or AdBlue. The reductant may, e.g., comprise approximately 32.5 wt % urea and 67.5 wt % deionized water. During use, when the reductant is injected into the fluid channel, the urea decomposes into ammonia and carbon dioxide. The ammonia then acts as the reductant in the SCR catalyst, reacting with NOx in the presence of the catalyst to convert the NOx into nitrogen and water.

In some embodiments, the control unit is configured to adjust the reductant injection rate of the injector to reduce the amount of ammonia reaching the ASC. A technical benefit may include reduced emissions from the exhaust aftertreatment unit. Thus, the emission related to ammonia slip of the SCR catalyst can be directly addressed. For example, the injection rate of the injector can be reduced in order to reduce the ammonia reaching the ASC. Hereby, undesirable emission of $N_2O$ out from the exhaust aftertreatment unit can be reduced.

In some embodiments, the one or more perforations are designed with a variable opening to control the flow rate of the by-pass flow. A technical benefit may include adaptive control of the by-pass flow rate. For example, the by-pass flow rate may be adapted by the variable opening of the one or more perforations in response to the exhaust gas pressure. The opening of the one or more perforations may, e.g., be varied by a valve. Thus, the control unit may be configured to control at least one valve for the one or more perforations in order to vary the openings thereof. For example, in the previously described embodiment in which the one or more perforations is at least one perforation, or a single perforation, the size of the opening of the single perforation may be controlled by a valve.

In some embodiments, the exhaust aftertreatment unit further comprises a particulate filter arranged upstream of the SCR catalyst. A technical benefit may include efficient removal of particulate matter in the exhaust gases. Thus, at least the SCR catalyst may be better protected from the adverse effects of particulate matter. For example, the particulate filter may be arranged inside the outer casing and upstream of the catalyst casing, or in a separate outer casing upstream of the outer casing comprising the catalyst casing.

In some embodiments, the exhaust aftertreatment unit further comprises a particulate filter arranged downstream of the ASC. Thus, the exhaust aftertreatment unit may comprise particulate filter arranged upstream of the SCR catalyst and/or a particulate filter arranged downstream of the ASC. In some embodiments, the ASC and the particulate filter are combined into one unit, i.e., an ASC including particulate filter functionality.

In some embodiments, the exhaust aftertreatment unit further comprises a particulate filter arranged downstream of the SCR catalyst. A technical benefit may include efficient removal of particulate matter in the exhaust gases, such as for example particles formed due to the injection of the reductant.

In some embodiments, the SCR catalyst is a downstream SCR catalyst, and the exhaust aftertreatment unit further comprising an upstream SCR catalyst arranged upstream of the particulate filter. A technical benefit may include a staged exhaust aftertreatment unit that can adapt to different levels of exhaust gas purification needs. For example, the upstream SCR catalyst may be arranged inside the outer casing and upstream of the catalyst casing, or in a separate outer casing upstream of the outer casing comprising the catalyst casing.

In some embodiments, the exhaust aftertreatment unit further comprises an oxidation catalyst arranged upstream of the particulate filter. A technical benefit may include improved conversion of hydrocarbons and carbon monoxide into carbon dioxide and water. Moreover, the oxidation catalyst may be configured to provide an optimal ratio of NO to NO2 in the exhaust gases for improved efficiency of the SCR catalyst. For example, the oxidation catalyst may be arranged inside the outer casing, and upstream of the catalyst casing, or in a separate outer casing upstream of the outer casing comprising the catalyst casing.

In some embodiments, the outer casing comprises an inner wall facing the fluid pathway and the catalyst casing comprises an outer wall facing the inner wall of the outer casing, and wherein the intermediate space is arranged between the inner wall of the outer casing and the outer wall of the catalyst casing. A technical benefit may include an advantageous space for the by-pass flow, improving measurement accuracy of the detector to measure ammonia and/or NOx in the exhaust gases including the by-pass flow. Thus, the intermediate space is outside of the catalyst casing, but inside of the outer casing. The one or more perforations are thus one or more perforations through the outer wall of the catalyst casing.

According to a second aspect of the disclosure, a vehicle comprising the exhaust aftertreatment unit of the first aspect of the disclosure is provided. The second aspect of the disclosure may seek to solve the same problem as described for the first aspect of the disclosure. Thus, effects and features of the second aspect of the disclosure are largely analogous to those described above in connection with the first aspect of the disclosure.

The disclosed aspects, examples, and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

The disclosed technology may solve the problem relating to measurement accuracy and/or unwanted emissions and/or exhaust aftertreatment adaptability. The disclosed technology provides an improved exhaust aftertreatment unit comprising an SCR catalyst and an ASC arranged downstream of the SCR catalyst, in which early detection of potential emission issues can be achieved by a detector being arranged and configured to measure ammonia and/or NOx in a by-pass flow originating from one or more perforations upstream of the ASC (or in the exhaust gas including the by-pass flow). That is, as the content of the exhaust gases in the by-pass flow is based on conditions upstream of the ASC, the measurement of ammonia and/or NOx by the detector will reflect, at least in part, the conditions upstream of the ASC. Hereby, an early detection of, e.g., ammonia, or of an undesirable high amount of ammonia, entering the ASC can be achieved, and proper response actions performed. For example, as ammonia may be converted into $N_2O$ in the ASC, and as $N_2O$ is not easily detected downstream of the ASC, this type of emission can be reduced, e.g., by reducing the reductant injection rate of an injector upstream of the SCR catalyst. Moreover, the positioning of the detector may be relatively freely chosen, as long as the detector is arranged to measure ammonia and/or NOx in an exhaust stream including the by-pass flow. Moreover, by the disclosed technology, the measuring accuracy of the ammonia and/or NOx can be improved in the exhaust stream including the by-pass flow, in particular under low flow conditions, as the use of sampling channels for measuring the corresponding parameter may be avoided.

Figure 1:
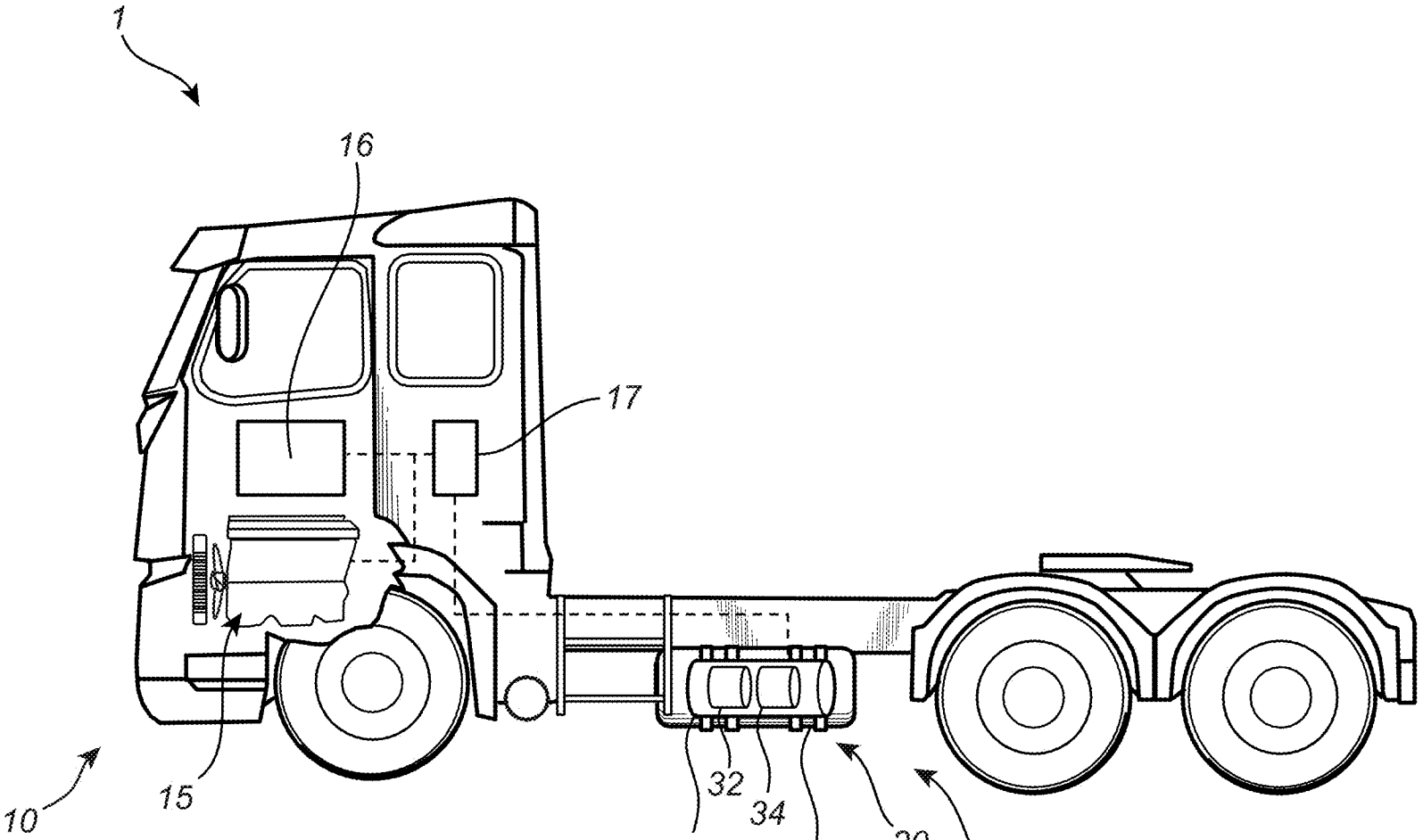
FIG. 1 is an exemplary, partly schematic, side view of a vehicle comprising an exhaust aftertreatment unit according to one example.

FIG. 1 is an exemplary vehicle 1, here embodied as a heavy duty truck 1, according to one example. The vehicle 1 comprises an internal combustion engine 15, such as, e.g., a hydrogen combustion engine or a diesel combustion engine, for propelling the vehicle 1, and an exhaust aftertreatment system, EATS 18 comprising at least an exhaust aftertreatment unit 20 for reducing the emissions of the exhaust gases from the internal combustion engine 15. However, the vehicle 1 may be a hybrid vehicle further comprising an electric traction machine 16 (optionally) for propelling the vehicle 1. The internal combustion engine 15 is powered by a gaseous fuel (e.g., in the case of a hydrogen combustion engine) or liquid fuel (e.g., in the case of a diesel combustion engine). The electric traction machine 16 is typically powered by electricity supplied from at least one energy storage or transformation device, e.g., a battery or a fuel cell (not shown). The internal combustion engine 15 and the electric traction machine 16 are typically arranged and configured to individually propel the vehicle 1, by being separately coupled to other parts of the powertrain of the vehicle 1, such as a transmission, drive shafts and wheels (not shown in detail). That is, the vehicle 1 may be propelled by the internal combustion engine 15 alone, the electric traction machine 16 alone, or by the internal combustion engine 15 together with the electric traction machine 16. The operation of the internal combustion engine 15, the optional electric traction machine 16 and the exhaust aftertreatment unit 20 may be controlled by a control unit 17.

In FIG. 1, the exhaust aftertreatment unit 20 is configured to reduce emission of the engine exhausts. The exhaust aftertreatment unit 20 typically comprise a catalyst casing housed in an outer casing 24, wherein the catalyst casing comprises a selective catalytic reduction catalyst, SCR 32 and an ammonia slip catalyst, ASC 34 arranged downstream of the SCR catalyst. The SCR catalyst 32 is configured to convert nitrogen oxides, also referred to as NOx, with the aid of a catalyst, into diatomic nitrogen and water. A reductant, typically anhydrous ammonia, aqueous ammonia, or a urea solution (commonly referred to as urea in the present disclosure), is added to exhaust gases and is absorbed onto the SCR catalyst 32. The ASC 34 is typically configured to reduce the emission of unreacted ammonia from the SCR catalyst 32, also known as ammonia slip, which can escape from the SCR catalyst 32. However, the ammonia entering the ASC 34 from the SCR catalyst 32 may be converted into $N_2O$, and as $N_2O$ is not easily detected downstream of the ASC 34, this type of emission may pass out of the EATS 18 unnoticed if not treated properly.

Figure 2:
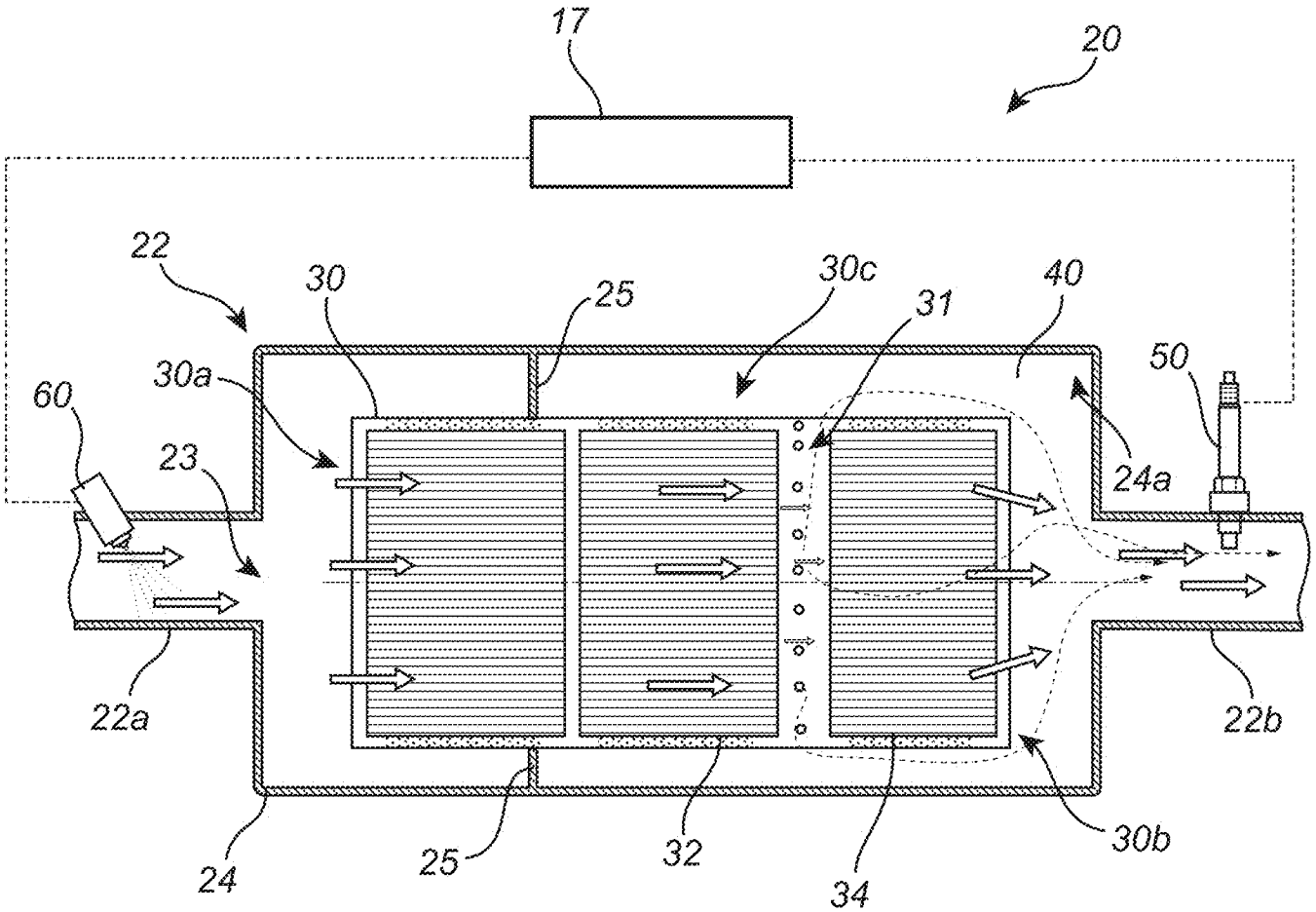
FIG. 2 is an exemplary, partly schematic, side view of the exhaust aftertreatment unit of FIG. 1 according to one example.

In FIG. 2, the exhaust aftertreatment unit 20 of FIG. 1 is shown in greater detail. The exhaust aftertreatment unit 20 comprises a fluid channel 22 for providing a fluid pathway 23 for the exhaust gases. The fluid channel 22 comprises an outer casing 24. The fluid channel 22 further comprises an inlet portion **22*a* for receiving the exhaust gases and an outlet portion 22*b* for discharging exhaust gases. The exhaust aftertreatment unit 20 further comprises a catalyst casing 30 housing the SCR catalyst 32 and the ASC 34 arranged downstream of the SCR catalyst 32 and described with reference to FIG. 1. An injector 60 configured to inject a reductant upstream of the SCR catalyst 32 is arranged in the inlet portion 22*a* of the fluid channel 22**.

The catalyst casing 30 is arranged inside the outer casing 24 to form an intermediate space 40 between the inner and outer casings 24, 30. In more detail, the outer casing 24 comprises an inner wall 24*a* facing the fluid pathway 23, and the catalyst casing 30 comprises an outer wall 30*c* facing the inner wall 24*a* of the outer casing 24, wherein the intermediate space 40 is arranged between the inner wall 24*a* of the outer casing 24 and the outer wall 30*c* of the catalyst casing 30. In other words, the outer wall 30*c* of the catalyst casing 30 faces the inner wall 24*a* of the outer casing 24. The catalyst casing 30 comprises a catalyst casing inlet 30*a* and a catalyst casing outlet 30*b* arranged downstream of the catalyst casing inlet 30*a*. The SCR catalyst 32 and the ASC 34 are arranged in between the catalyst casing inlet 30*a* and the catalyst casing outlet 30*b*.

The exhaust aftertreatment unit 20 further comprises a detector 50 configured to measure ammonia and/or NOx in the exhaust gases. The detector 50 may comprise an ammonia sensor and/or a NOx sensor. In case the detector 50 comprises an ammonia sensor, the ammonia sensor is typically configured to specifically detect ammonia in the exhaust gases. In case the detector 50 comprises a NOx sensor, the NOx sensor is typically configured to specifically detect NOx in the exhaust gases but may additionally (and at least indirectly) be configured to measure the amount of ammonia in the exhaust gases. In the example of FIG. 2, the detector 50 is arranged in the outlet portion 22*b*, being in fluid communication, such as direct fluid communication, with the intermediate space 40. However, owing to a separation wall 25, described in more detail below, the intermediate space 40 is not in direct fluid communication with the exhaust gases upstream of the catalyst casing 30. Thus, the intermediate space 40 is in direct fluid communication with the outlet portion 22*b*, but not with an upstream space between the catalyst casing 30 and the outer casing 24 upstream of the catalyst casing 30, or of the inlet portion 22*a* of the fluid channel 22, as at least the SCR catalyst 32 is arranged in between.

As shown in FIG. 2, the catalyst casing 30 comprises one or more perforations 31 upstream of the ASC 34. The one or more perforations 31 are here illustrated as a plurality of perforations 31 distributed evenly along a circumference of the catalyst casing 30. The perforations 31 are arranged in the catalyst casing 30 downstream of the SCR catalyst 32 and upstream of the ASC 34. Through the perforations 31, a by-pass flow of exhaust gases may escape from inside the catalyst casing 30 into the intermediate space 40. Thus, the composition of the by-pass flow will reflect that of the exhaust gases treated by the SCR catalyst 32, but not of the ASC 34. As shown in FIG. 2, the detector 50 is arranged in the fluid channel 22 downstream of the ASC 34, here in the outlet portion 22*b* of the fluid channel 22, whereby the detector 50 is arranged to measure the ammonia and/or NOx in the exhaust gases including the by-pass flow. That is, as the by-pass flow in the intermediate space 40 is mixed with the exhaust gases exiting the ASC 34, the exhaust gases in the outlet portion 22*b* will include the exhaust gases from the by-pass flow, and the detector 50 can measure ammonia and/or NOx in the exhaust gases including the by-pass flow. Thus, as the content of the exhaust gases in the by-pass flow is based on conditions upstream of the ASC 34 and downstream of the SCR catalyst 32, the measurement of ammonia and/or NOx by the detector 50 will reflect, at least in part, the conditions of the exhaust gases in the catalyst casing upstream of the ASC 34 and downstream of the SCR catalyst 32. For example, an early detection of ammonia, or of an undesirable high amount of ammonia, entering the ASC 34 from the SCR catalyst 32 can be achieved by the detector 50.

The exhaust aftertreatment unit 20 may furthermore comprise a separation wall 25 arranged in the fluid channel 22 between the outer casing 24 and the catalyst casing 30. The separation wall 25 is being arranged upstream of the perforations 31 for preventing direct fluid communication between the inlet portion 22*a* of the fluid channel 20, and the intermediate space 40. Stated differently, the separation wall 25 is arranged to sealingly contact the inner wall 24*a* of the outer casing 24 and extend to sealingly contact the outer wall 30*c* of the catalyst casing 30.

The control unit 17 may be configured to adjust the reductant injection rate of the injector 60 in response to the measured ammonia and/or NOx by the detector 50. For example, the control unit 17 may be configured to adjust the reductant injection rate of the injector 60 to reduce the amount of ammonia reaching the ASC 34. Thus, the control unit 17 may perform a proper response action to an early detection of potential emission issues, based on the measurement of ammonia and/or NOx by the detector 50, and reduce the reductant injection rate of the injector 60 to reduce the ammonia reaching the ASC 34.

Figure 3:
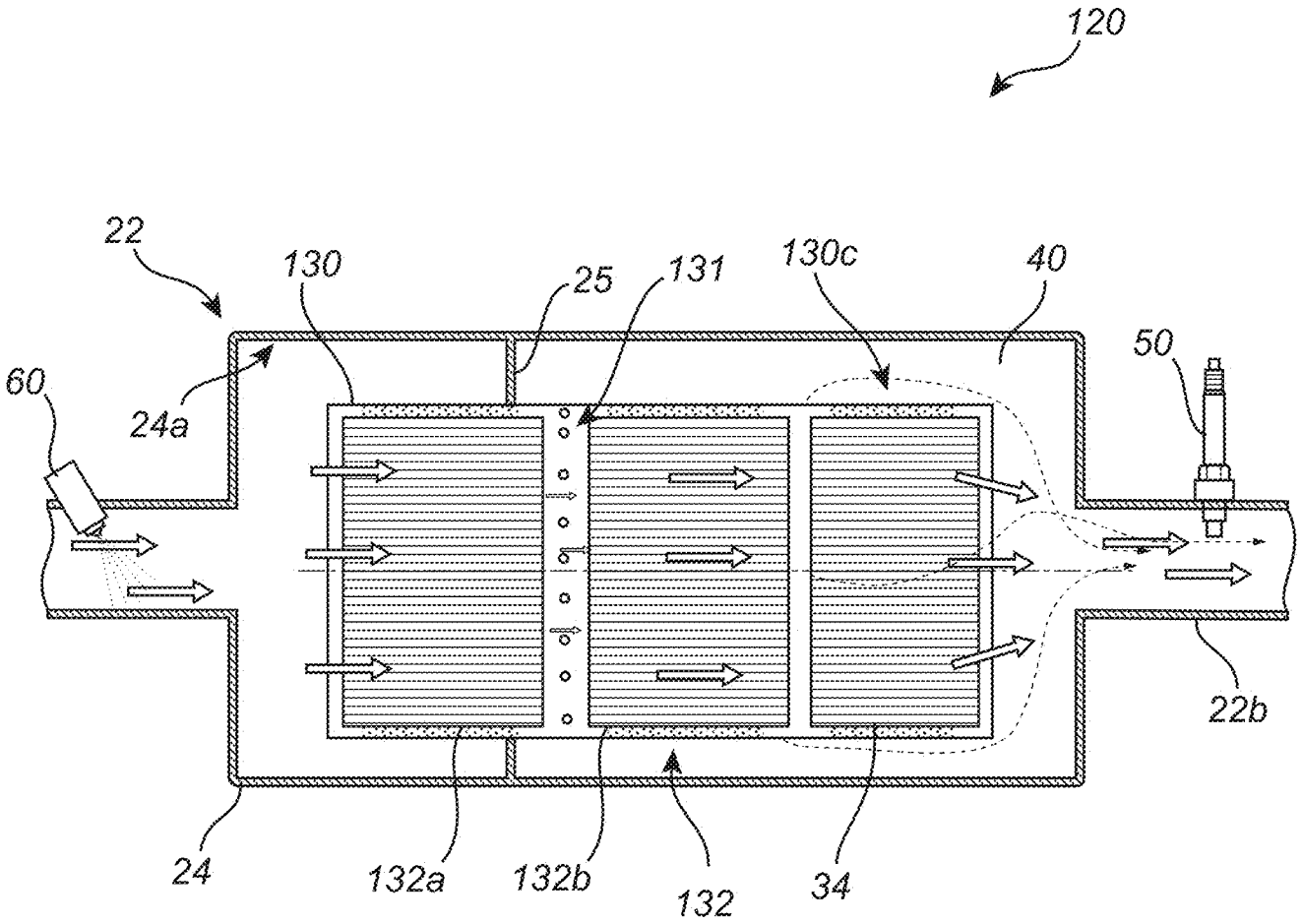
FIG. 3 is an exemplary, partly schematic, side view of an exhaust aftertreatment unit according to one example.

Turning to FIG. 3 showing a similar exhaust aftertreatment unit 120 to that of FIG. 2. Thus, the exhaust aftertreatment unit 120 of FIG. 3 may be used in the EATS 18 of vehicle 1 in FIG. 1. In FIG. 3, only the catalyst casing 130, and some components therein, differ from the example of FIG. 2; like references are used for like features and are typically not repeated in detail again.

In FIG. 3, the SCR catalyst 132 is physically divided into a SCR upstream part 132*a* and a SCR downstream part 132*b* arranged downstream of the SCR upstream part 132*a*. As shown in FIG. 3, the catalyst casing 130 comprises an outer wall 130*c* and one or more perforations 131 upstream of the ASC 34. The one or more perforations 131 are here a plurality of perforations 131 distributed evenly along a circumference of the catalyst casing 130. The perforations 131 are arranged in the catalyst casing 130 downstream of the SCR upstream part 132*a* and upstream of the SCR downstream part 132*b* (and upstream of the ASC 34). Through the perforations 131, a by-pass flow of exhaust gases may escape from inside the catalyst casing 130 into the intermediate space 40. Thus, the composition of the by-pass flow will reflect that of the exhaust gases treated by the SCR upstream part 132*a*, but not of the SCR downstream part 132*b* or of the ASC 34. As shown in FIG. 3, the detector 50 is arranged as in the example of FIG. 2 and is thus arranged to measure the ammonia and/or NOx in the exhaust gases including the by-pass flow. Thus, as the content of the exhaust gases in the by-pass flow is based on conditions downstream of the SCR upstream part 132*a* and upstream of the SCR downstream part 132*b*, the measurement of ammonia and/or NOx by the detector 50 will reflect, at least in part, the conditions of the exhaust gases in the catalyst casing downstream of the SCR upstream part 132*a* and upstream of the SCR downstream part 132*b*. Hereby, any ammonia (or NOx) which slips out of the SCR upstream part 132*a* may be detected by the detector 50. The exhaust aftertreatment unit 120 of FIG. 3 may be controlled by a control unit 17 in a corresponding manner as described for the exhaust aftertreatment unit of FIG. 2.

Figure 4:
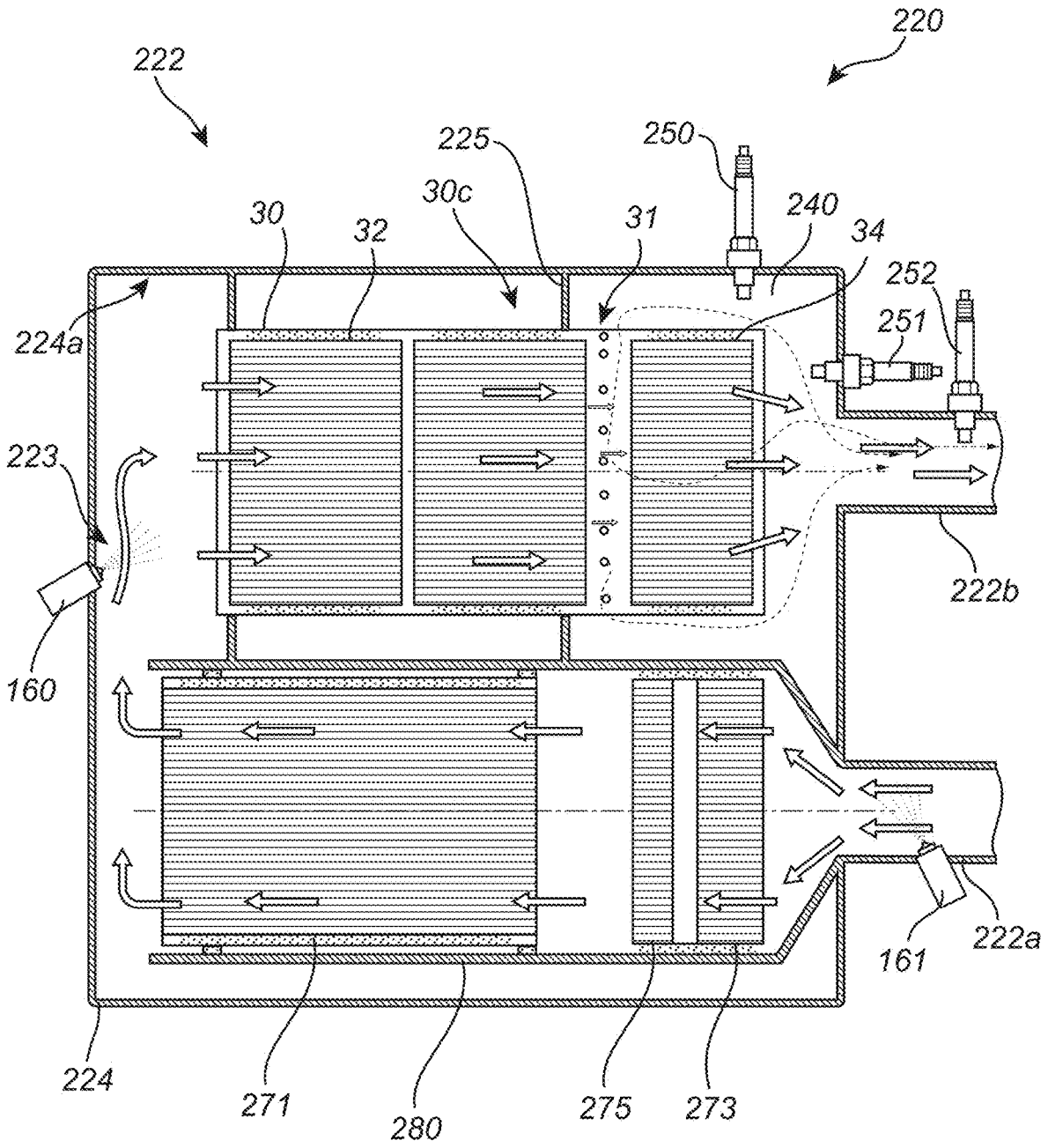
FIG. 4 is an exemplary, partly schematic, side view of an exhaust aftertreatment unit according to one example.

FIG. 4 shows another exhaust aftertreatment unit 220 compared to those described with reference to FIGS. 2 and 3. The exhaust aftertreatment unit 220 of FIG. 4 may be used in the EATS 18 of vehicle 1 in FIG. 1. In FIG. 4, the catalyst casing 30, and all of components therein, are the same in the example of FIG. 2; like references are used for like features and are typically not repeated in detail again. Thus, the catalyst casing 30 comprises corresponding perforations 31 for providing a by-pass flow as previously described.

In FIG. 4, the exhaust aftertreatment unit 220 comprises a particulate filter 271 arranged upstream of the SCR catalyst 32 in the catalyst casing 30. Hereby, particulate matter in the exhaust gases may be removed, or at least reduced, prior to entering the catalyst casing and the SCR catalyst 32. The exhaust aftertreatment unit 220 further comprises an oxidation catalyst 275 arranged upstream of the particulate filter 271. Hereby, an improved conversion of hydrocarbons and carbon monoxide into carbon dioxide and water can be achieved. Moreover, the oxidation catalyst 275 may be configured to provide an optimal ratio of NO to NO2 in the exhaust gases for improved efficiency of the SCR catalyst 32 in the catalyst casing 30. Moreover, the exhaust aftertreatment unit 220 of FIG. 4 comprises a secondary SCR catalyst 273 arranged between the oxidation catalyst 275 and the particulate filter 271. The secondary SCR catalyst 273 may be referred to as an upstream SCR catalyst 273 and the SCR catalyst 32 in the catalyst casing 30 may be referred to as a downstream SCR catalyst 32. As shown in FIG. 4, the oxidation catalyst 275, the secondary upstream SCR catalyst 273 and the particulate filter 271 may be comprised in a filter casing 280. The filter casing 280 may thus be arranged upstream of the catalyst casing 30.

As in the exhaust aftertreatment unit 20 in FIG. 2, the exhaust aftertreatment unit 220 of FIG. 4 comprises a fluid channel 222 for providing a fluid pathway 223 for the exhaust gases. The fluid channel 222 comprises an inlet portion 222*a* upstream of the filter casing 280, and an outlet portion 222*b* downstream of the catalyst casing 30. The fluid channel 222 comprises an outer casing 224 housing the filter casing 280 and the catalyst casing 30. The exhaust aftertreatment unit 220 further a downstream injector 160 configured to inject a reductant upstream of the downstream SCR catalyst 32, and an upstream injector 161 configured to inject a reductant upstream of the upstream SCR catalyst 273. Hereby, both SCR catalysts 32, 273 may receive a reductant to achieve the NOx conversion as previously described. In FIG. 4, the downstream injector 160 is arranged in the outer casing 224 upstream of the catalyst casing 30 and downstream of the filter casing 280, and the upstream injector 161 is arranged in the inlet portion 222*a* of the fluid channel 220.

As in the exhaust aftertreatment unit 20 in FIG. 2, the catalyst casing 30 is arranged inside the outer casing 224 to form an intermediate space 240 between the inner and outer casings 224, 30. The outer casing 224 comprises an inner wall 224*a* facing the fluid pathway 223, and the catalyst casing 30 comprises an outer wall 30*c* facing the inner wall 224*a* of the outer casing 24, wherein the intermediate space 240 is arranged between the inner wall 224*a* of the outer casing 224 and the outer wall 30*c* of the catalyst casing 30, similar to the intermediate space 40 of the example in FIG. 2. Moreover, the exhaust aftertreatment unit 220 comprises a separation wall 225 preventing direct fluid communication between upstream the catalyst casing 30 and the intermediate space 240.

In FIG. 4, three various positions of a detector 250, 251, 252 configured to measure ammonia and/or NOx in the exhaust gases are shown. It should be understood that only one detector 250, 251, 252 need be provided in one of the three positions, but according to one example, two detectors 250, 251, 252 in at least two of the positions, or three detectors 250, 251, 252 in all three of the positions are included in the exhaust aftertreatment unit 220. The detector(s) 250, 251, 252 typically correspond to the detector 50 of the exhaust aftertreatment unit 20 in FIG. 2. A first detector 250 is arranged in a first position being parallel to the ASC 34. Thus, the first detector 250 is arranged in the intermediate space 240 parallel to the ASC 34 and is arranged to measure the ammonia and/or NOx in the exhaust gases including the by-pass flow. The positioning of the first detector 250 may be advantageous, as the by-pass flow has not yet been mixed with the exhaust gases exiting the ASC 34, facilitating the detection of ammonia and/or NOx in the exhaust gases between the downstream SCR catalyst 32 and the ASC 34. A second detector 251 is arranged in a second position being downstream the ASC 34, but upstream of the outlet portion 222*b* of the fluid channel 222. Thus, the second detector 251 is arranged in the intermediate space 240 downstream of the ASC 34 and is arranged to measure the ammonia and/or NOx in the exhaust gases including the by-pass flow. The positioning of the second detector 251 may be advantageous, as the flow of exhaust gases is higher compared to the flow in the first position, but the by-pass flow has not yet been fully mixed with the exhaust gases exiting the ASC 34. A third detector 252 is arranged in a third position being downstream the ASC 34, and inside outlet portion 222*b* of the fluid channel 222. Thus, the third detector 252 is arranged in the intermediate space 240 downstream of the ASC 34 and is arranged to measure the ammonia and/or NOx in the exhaust gases including the by-pass flow. The positioning of the third detector 252 is similar to the exhaust aftertreatment units 20, 120 of FIGS. 2 and 3. The exhaust aftertreatment unit 220 of FIG. 4 may be controlled by a control unit 17 in a corresponding manner as described for the exhaust aftertreatment unit 20 of FIG. 2.

Figure 5:
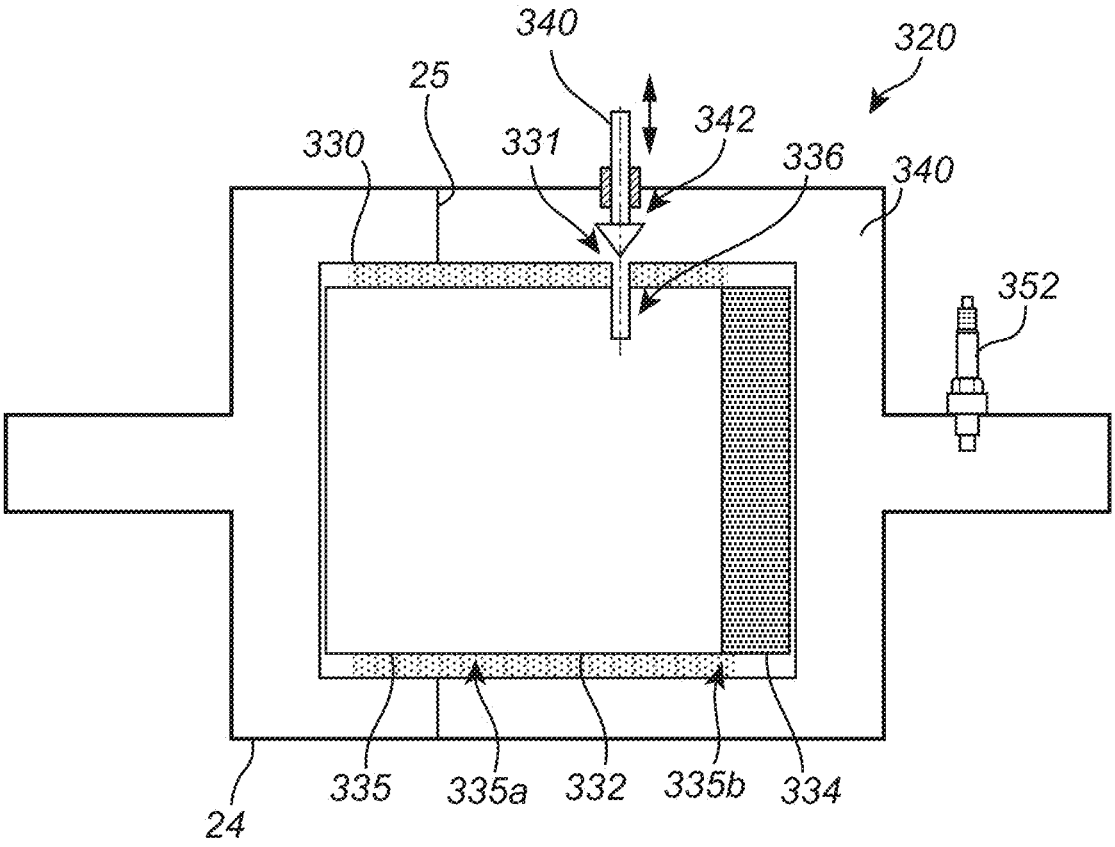
FIG. 5 is an exemplary, partly schematic, side view of an exhaust aftertreatment unit according to one example.

Turning to FIG. 5, a similar exhaust aftertreatment unit 320 to that of FIG. 2 is shown. Thus, the exhaust aftertreatment unit 320 of FIG. 3 may be used in the EATS 18 of vehicle 1 in FIG. 1. In FIG. 5, mainly the catalyst casing 330, and some components therein, differ from the example of FIG. 2; like references being used for like features and are typically not repeated in detail again.

In FIG. 5, the SCR catalyst 332 and the ASC 334 are comprised in a common catalyst substrate 335. Thus, the SCR catalyst 332 in the catalyst casing 330 is formed by an SCR catalyst coating in an upstream portion 335*a* of the common catalyst substrate 335, and the ASC 334 is formed by an ASC coating in a downstream portion 335*b* of the common catalyst substrate 335. Moreover, in the example of FIG. 5, the corresponding one or more perforations 331 of the catalyst casing 330 is a single perforation 331 arranged upstream of the ASC 334 (or ASC coating). For example, the perforation 331 may be arranged parallel to the SCR catalyst 332 (or SCR coating). Through the perforation 331, a by-pass flow of exhaust gases may escape from inside the catalyst casing 30 into an intermediate space 340, as previously described. Hereby, the content of the exhaust gases in the by-pass flow is based on conditions in the catalyst substrate 335, at least upstream of the ASC 334. Hereby, measurement of ammonia and/or NOx by a detector 352 will reflect, at least in part, the conditions of the exhaust gases in the catalyst substrate 335 upstream of the ASC 334.

As also shown in FIG. 5, the opening of the perforation 331 may be variable. That is, the perforation 31 may be designed with a variable opening to control the flow rate of the by-pass flow. The opening of the perforation 331, such as, e.g., a diameter of the perforation, may be controlled by a valve 340. The valve 340 may, e.g., be configured to move a valve head 342 towards, and possibly into, the opening of the perforation 331 to reduce, or even close the opening. Correspondingly, the valve 340 may be configured to move the valve head 342 away from, and possibly out of, the opening of the perforation 331 to increase, and even fully open, the opening.

The catalyst substrate 335 may comprise a borehole 336 aligned with the perforation 331. Thus, the borehole and the opening of the perforation 331 may share a common geometrical axis. The borehole 336 may, e.g., extend from a periphery of the catalyst substrate 335 and into the catalyst substrate 335 in a direction towards the center thereof. For example, the borehole 336 may be arranged to extend into the SCR catalyst 332 (or SCR catalyst coating) of the catalyst substrate 335, wherein the one or more perforations 331 are aligned with the borehole 336. Hereby, the by-pass flow from the perforation 331 may be targeted to a position within the SCR catalyst 332. The exhaust aftertreatment unit 320 of FIG. 5 may be controlled by a control unit 17 in a corresponding manner as described for the exhaust aftertreatment unit of FIG. 2.

Example 1. An exhaust aftertreatment unit for cleaning exhaust gases, the exhaust aftertreatment unit comprising: a fluid channel for providing a fluid pathway for the exhaust gases, the fluid channel comprising an outer casing; a catalyst casing housing a selective catalytic reduction, SCR, catalyst and an ammonia slip catalyst, ASC, arranged downstream of the SCR catalyst, the catalyst casing being arranged inside the outer casing forming an intermediate space between the inner and outer casings; and a detector configured to measure ammonia and/or NOx in the exhaust gases; wherein the catalyst casing comprises one or more perforations upstream of the ASC to enable a by-pass flow of exhaust gases from inside the catalyst casing into the intermediate space, and wherein the detector is arranged in the fluid channel to measure the ammonia and/or NOx in the exhaust gases including the by-pass flow.

Example 2. The exhaust aftertreatment unit of claim 1, wherein the detector is arranged in fluid communication with the intermediate space.

Example 3. The exhaust aftertreatment unit of any of examples 1-2, wherein the detector is arranged in the fluid channel parallel to, or downstream of, the ASC.

Example 4. The exhaust aftertreatment unit of any of examples 1-3, wherein the fluid channel further comprises an inlet portion for receiving the exhaust gases to the catalyst casing, and an outlet portion for discharging exhaust gases from the catalyst casing and the intermediate space, wherein the detector is arranged in the intermediate space or in the outlet portion.

Example 5. The exhaust aftertreatment unit of example 4, wherein the intermediate space is in direct fluid communication with the outlet portion.

Example 6. The exhaust aftertreatment unit of any of examples 4-5, further comprising a separation wall arranged in the fluid channel between the outer casing and the catalyst casing, the separation wall being arranged upstream of the one or more perforations for preventing direct fluid communication between the inlet portion and the intermediate space.

Example 7. The exhaust aftertreatment unit of any of examples 1-6, wherein the catalyst casing comprises a catalyst casing inlet and a catalyst casing outlet arranged downstream of the catalyst casing inlet, and wherein the SCR catalyst and the ASC are arranged in between the catalyst casing inlet and catalyst casing outlet.

Example 8. The exhaust aftertreatment unit of any of examples 1-7, wherein the one or more perforations of the catalyst casing is arranged in between the SCR catalyst and the ASC.

Example 9. The exhaust aftertreatment unit of any of examples 1-7, wherein the SCR catalyst is physically divided into an SCR upstream part and an SCR downstream part, and wherein the one or more perforation of the catalyst casing is arranged in between the SCR upstream part and the SCR downstream part.

Example 10. The exhaust aftertreatment unit of any of examples 1-9, wherein the one or more perforations are a plurality of perforations distributed evenly along a circumference of the catalyst casing.

Example 11. The exhaust aftertreatment unit of any of examples 1-10, wherein the SCR catalyst and the ASC are comprised in a common catalyst substrate.

Example 12. The exhaust aftertreatment unit of any of examples 1-11, further comprising a borehole in the SCR catalyst, wherein the one or more perforations are aligned with the borehole.

Example 13. The exhaust aftertreatment unit of any of examples 1-12, further comprising an injector configured to inject a reductant upstream of the SCR catalyst.

Example 14. The exhaust aftertreatment unit of example 13, further comprising a control unit configured to adjust the reductant injection rate of the injector in response to the measured ammonia and/or NOx by the detector.

Example 15. The exhaust aftertreatment unit of example 14, wherein the control unit is configured to adjust the reductant injection rate of the injector to reduce the amount of ammonia reaching the ASC.

Example 16. The exhaust aftertreatment unit of any of examples 1-15, wherein the one or more perforations are designed with a variable opening to control the flow rate of the by-pass flow.

Example 17. The exhaust aftertreatment unit of any of examples 1-16, further comprising a particulate filter arranged upstream of the SCR catalyst.

Example 18. The exhaust aftertreatment unit of example 17, wherein the SCR catalyst is a downstream SCR catalyst, and the exhaust aftertreatment unit further comprising an upstream SCR catalyst arranged upstream of the particulate filter.

Example 19. The exhaust aftertreatment unit of any of examples 1-18, wherein the outer casing comprises an inner wall facing the fluid pathway and the catalyst casing comprises an outer wall facing the inner wall of the outer casing, and wherein the intermediate space is arranged between the inner wall of the outer casing and the outer wall of the catalyst casing.

Example 20. A vehicle comprising the exhaust aftertreatment unit of any of examples 1-19.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. An exhaust aftertreatment unit for cleaning exhaust gases, the exhaust aftertreatment unit comprising:

a fluid channel for providing a fluid pathway for the exhaust gases, the fluid channel comprising an outer casing, a catalyst casing housing a selective catalyst reduction (SCR) catalyst and an ammonia slip catalyst (ASC) arranged downstream of the SCR catalyst, the catalyst casing being arranged inside the outer casing forming an intermediate space between the inner and outer casings, and a detector configured to measure ammonia and/or NOx in the exhaust gases, wherein the catalyst casing comprises one or more perforations upstream of the ASC to enable a by-pass flow of exhaust gases from inside the catalyst casing into the intermediate space, and wherein the detector is arranged in the fluid channel to measure the ammonia and/or NOx in the exhaust gases including the by-pass flow.

2. The exhaust aftertreatment unit of claim 1, wherein the detector is arranged in fluid communication with the intermediate space.

3. The exhaust aftertreatment unit of claim 1, wherein the detector is arranged in the fluid channel parallel to, or downstream of, the ASC.

4. The exhaust aftertreatment unit of claim 1, wherein the fluid channel further comprises an inlet portion for receiving the exhaust gases to the catalyst casing, and an outlet portion for discharging exhaust gases from the catalyst casing and the intermediate space, wherein the detector is arranged in the intermediate space or in the outlet portion.

5. The exhaust aftertreatment unit of claim 4, wherein the intermediate space is in direct fluid communication with the outlet portion.

6. The exhaust aftertreatment unit of claim 4, further comprising a separation wall arranged in the fluid channel between the outer casing and the catalyst casing, the separation wall being arranged upstream of the one or more perforations for preventing direct fluid communication between the inlet portion and the intermediate space.

7. The exhaust aftertreatment unit of claim 1, wherein the catalyst casing comprises a catalyst casing inlet and a catalyst casing outlet arranged downstream of the catalyst casing inlet, and wherein the SCR catalyst and the ASC are arranged in between the catalyst casing inlet and catalyst casing outlet.

8. The exhaust aftertreatment unit of claim 1, wherein the one or more perforations of the catalyst casing is arranged in between the SCR catalyst and the ASC.

9. The exhaust aftertreatment unit of claim 1, wherein the SCR catalyst is physically divided into a SCR upstream part and a SCR downstream part, and wherein the one or more perforations of the catalyst casing is arranged in between the SCR upstream part and the SCR downstream part.

10. The exhaust aftertreatment unit of claim 1, wherein the one or more perforations are a plurality of perforations distributed evenly along a circumference of the catalyst casing.

11. The exhaust aftertreatment unit of claim 1, wherein the SCR catalyst and the ASC are comprised in a common catalyst substrate.

12. The exhaust aftertreatment unit of claim 1, further comprising a borehole in the SCR catalyst, wherein the one or more perforations are aligned with the borehole.

13. The exhaust aftertreatment unit of claim 1, further comprising an injector configured to inject a reductant upstream of the SCR catalyst.

14. The exhaust aftertreatment unit of claim 13, further comprising a control unit configured to adjust the reductant injection rate of the injector in response to the measured ammonia and/or NOx by the detector.

15. The exhaust aftertreatment unit of claim 14, wherein the control unit is configured to adjust the reductant injection rate of the injector to reduce the amount of ammonia reaching the ASC.

16. The exhaust aftertreatment unit of claim 1, wherein the one or more perforations are designed with a variable opening to control the flow rate of the by-pass flow.

17. The exhaust aftertreatment unit of claim 1, further comprising a particulate filter arranged upstream of the SCR catalyst.

18. The exhaust aftertreatment unit of claim 17, wherein the SCR catalyst is a downstream SCR catalyst, and the exhaust aftertreatment unit further comprising an upstream SCR catalyst arranged upstream of the particulate filter.

19. The exhaust aftertreatment unit of claim 1, wherein the outer casing comprises an inner wall facing the fluid pathway and the catalyst casing comprises an outer wall facing the inner wall of the outer casing, and wherein the intermediate space is arranged between the inner wall of the outer casing and the outer wall of the catalyst casing.

20. A vehicle comprising the exhaust aftertreatment unit of claim 1.

* * * * *